US009583826B2

(12) United States Patent
Chuang et al.

(10) Patent No.: US 9,583,826 B2
(45) Date of Patent: Feb. 28, 2017

(54) RESONANCE CIRCUIT FOR INHIBITING INTERFERENCE BETWEEN HIGH-SPEED CONNECTOR AND ANTENNA

(71) Applicant: Alpha Networks Inc., Hsinchu (TW)

(72) Inventors: Fu-Chi Chuang, Hsinchu (TW); Yu-Cheng Huang, Hsinchu (TW)

(73) Assignee: ALPHA NETWORKS INC., Hsinchu (TW)

( * ) Notice: Subject to any disclaimer, the term of this patent is extended or adjusted under 35 U.S.C. 154(b) by 243 days.

(21) Appl. No.: 14/309,254

(22) Filed: Jun. 19, 2014

(65) Prior Publication Data

US 2015/0214614 A1 Jul. 30, 2015

(30) Foreign Application Priority Data

Jan. 27, 2014 (TW) ..... 103102923 A

(51) Int. Cl.

| | |
|---|---|
| ***H01Q 1/52*** | (2006.01) |
| ***H01Q 1/22*** | (2006.01) |
| ***H01Q 1/24*** | (2006.01) |
| ***H01Q 9/42*** | (2006.01) |

(52) U.S. Cl.

CPC ..... *H01Q 1/526* (2013.01); *H01Q 1/2275* (2013.01); *H01Q 1/243* (2013.01); *H01Q 9/42* (2013.01)

(58) Field of Classification Search

CPC ..... H01Q 1/526; H01Q 1/2275

See application file for complete search history.

(56) References Cited

U.S. PATENT DOCUMENTS

| | | | | |
|---|---|---|---|---|
| 7,176,839 B2 * | 2/2007 | Ueda | ..... | H01Q 1/22 343/702 |
| 2010/0231459 A1 * | 9/2010 | Kawata | ..... | H01Q 1/243 343/702 |

* cited by examiner

*Primary Examiner* — Dameon E Levi
*Assistant Examiner* — Amal Patel
(74) *Attorney, Agent, or Firm* — Bacon & Thomas, PLLC

(57) ABSTRACT

The present invention is to provide a resonance circuit, which is applicable to a circuit board of a first electronic device provided thereon with a circuit layout, a high-speed connector (e.g., a USB 3.0 connector) at a lateral side of the circuit layout for connecting with a second electronic device, and an antenna for enabling the circuit board to receive and transmit wireless information at a predetermined frequency. The connector and antenna are respectively connected to first and second connecting points of the circuit layout, and the distance between the two connecting points is not less than one wavelength. The resonance circuit is connected to a third connecting point of the circuit layout provided between the above two connecting points, such that the resonance frequency of the resonance circuit covers the reception and transmission frequencies of the antenna, for effectively inhibiting interference between the connector and the antenna.

12 Claims, 3 Drawing Sheets

RESONANCE CIRCUIT FOR INHIBITING INTERFERENCE BETWEEN HIGH-SPEED CONNECTOR AND ANTENNA

FIELD OF THE INVENTION

The present invention relates a resonance circuit, more particularly to a resonance circuit applicable to a circuit board of a first electronic device having a circuit layout, a high-speed connector (e.g., a USB 3.0 connector) provided at a lateral side of the circuit layout for connecting with a second electronic device, and an antenna for enabling the circuit board to receive and transmit wireless signal at a predetermined frequency (e.g., 2.4 GHz). The connector and antenna are respectively connected to first and second connecting points of the circuit layout, and the distance between the two connecting points is not less than one wavelength of the wireless signal. The resonance circuit is connected to a third connecting point of the circuit layout provided between the above two connecting points, such that the resonance frequency (e.g., 2.4~2.5 GHz) of the resonance circuit covers the reception and transmission frequencies of the antenna, for effectively inhibiting interference between the connector and the antenna.

BACKGROUND OF THE INVENTION

With the progress of electronics, the development of electronic devices has tended toward miniaturization and lightweight. In particular, as the market of portable electronic devices (e.g., mobile phones, personal digital assistants, and tablet computers) prospers in recent years, the demand for ease of carry has driven these devices to extreme compactness. Meanwhile, in order to satisfy people's needs to watch or listen to various multimedia information through such electronic devices, the sizes of digital files or digital information flows have increased so much that the speed and stability of digital information transmission have been important factors in developing electronic devices.

Now that electronic devices are made increasingly thinner, external antennae have been almost completely dispensed with and replaced by built-in ones, and the internal space of an electronic device is reducing. On the other hand, in order to improve the transmission speed of digital information, it is common practice nowadays to equip an electronic device with a high-speed connector capable of fast digital information transmission, some examples of which are connectors conforming to the Universal Serial Bus (USB) 3.0 specifications, High-Definition Multimedia Interface (HDMI) connectors, DisplayPort connectors, and Thunderbolt connectors. While the pursuit of miniaturization has rendered electronic devices much more convenient to carry, and high-speed connectors have substantially increased the transmission efficiency of digital information, an attempt to achieve the above two goals at the same time gives rise to new problems.

Today, the antennae of the foregoing electronic devices typically transmit digital information over the 2.4 GHz radio frequency band via a wireless transmission protocol such as the IEEE 802.11 b/g/n or Bluetooth. As to wire-based transmission, the aforementioned high-speed connectors are now widely used in place of their low-frequency counterparts. Although the radiation signals generated by a low-frequency connector during signal transmission does not interfere with the reception and transmission of digital information by the 2.4 GHz antennae described above, the same cannot be said of high-speed connectors. When transmission of information takes place between two electronic devices by way of high-speed connectors, the radiation signals generated by the connectors will contain noise whose frequency is close to the reception and transmission frequency of the antennae of the electronic devices, and which therefore compromises the stability with which the antennae receive and transmit digital information. Moreover, as electronic devices become progressively smaller, it is practically impossible to "increase the distance between a high-speed connector and an antenna" as a way to keep the antenna from noise interference. To solve the problem, some manufacturers provide high-speed connectors, or their high speed transmission signal lines, with a shielding housing for blocking the noise generated by the high-speed connectors during signal transmission. Alternatively, some manufacturers add a wave-absorbing material to the signal lines of high-speed connectors in order to absorb the noise generated by the high-speed connectors during signal transmission. While the approaches stated above do offer solutions to the noise interference problem, the provision of the shielding housing or the wave-absorbing material causes an increase in production costs, which leaves something to be desired.

To sum up, the design of a conventional electronic device often fails to balance between miniaturization and high signal transmission speed. Although attempts have been made to solve the problem, the proposed solutions incur high production costs. Hence, the issue to be addressed by the present invention is to inhibit interference between a high-speed connector and an antenna in an effective and cost-effective way.

BRIEF SUMMARY OF THE INVENTION

In view of the aforesaid drawbacks of the conventional electronic devices in design, the inventor of the present invention put years of practical experience in the related industries into extensive research and experiment and finally succeeded in developing a resonance circuit for inhibiting interference between a high-speed connector and an antenna. The invention is intended to solve all the foregoing problems at once.

The first objective of the present invention is to provide a resonance circuit for inhibiting interference between a high-speed connector and an antenna. The resonance circuit is applicable to the circuit board of an electronic device, wherein the circuit board is provided thereon with a circuit layout, a high-speed connector (e.g., a USB 3.0 connector), and an antenna. The high-speed connector and one end of the antenna are respectively connected to a first connecting point and a second connecting point of the circuit layout, wherein a distance between the first connecting point and the second connecting point is not less than one wavelength of wireless signal transmitted through the antenna. The high-speed connector is provided at a lateral side of the circuit layout in order for a second electronic device to transmit information to and from the electronic device via the high-speed connector. The antenna enables the electronic device to receive and transmit the wireless signal at a predetermined frequency (e.g., 2.4 GHz). The resonance circuit is characterized in that it is connected to a third connecting point of the circuit layout, that the third connecting point is provided between the first connecting point and the second connecting point, and that the resonance frequency (e.g., 2.4~2.5 GHz) of the resonance circuit covers the reception and transmission frequency of the antenna. Thus, when information transmission takes place between the electronic device and a second electronic device through the high-speed connector, noise which is contained in the radiation signals generated by the high-speed connector and whose frequency is close to the frequency of the antenna will be absorbed by the resonance circuit between the high-speed connector and the antenna and will not affect the operation of a wireless receiver or transmitter via the antenna and high-speed connector. Compared with the prior art approaches, which involve adding a shielding housing to the high-speed connector or adding a shielding housing above the high speed transmission signal line or a wave-absorbing material to the signal lines of the high-speed connector, the present invention is obviously more advantageous in terms of cost.

The second objective of the present invention is to provide the foregoing resonance circuit, wherein the high-speed connector on the circuit board is a USB 3.0 connector, an HDMI connector, a DisplayPort connector, or a Thunderbolt connector.

The third objective of the present invention is to provide the foregoing resonance circuit, wherein the antenna on the circuit board is a microstrip antenna (e.g., an L-shaped microstrip antenna), and one end of the microstrip antenna is connected to the second connecting point of the circuit layout.

The fourth objective of the present invention is to provide the foregoing resonance circuit, wherein the antenna on the circuit board is an etched antenna (e.g., an L-shaped etched antenna) which starts from the second connecting point of the circuit layout.

The fifth objective of the present invention is to provide the foregoing resonance circuit, wherein the resonance circuit is a microstrip line (e.g., an L-shaped microstrip line), and one end of the microstrip line is connected to the third connecting point of the circuit layout.

The sixth objective of the present invention is to provide the foregoing resonance circuit, wherein the resonance circuit is an etched line (e.g., an L-shaped etched line) which starts from the third connecting point of the circuit layout.

The seventh objective of the present invention is to provide the foregoing resonance circuit, wherein the length of the resonance circuit ranges from one fifth to one third of a wavelength of the wireless signal.

The eighth objective of the present invention is to provide the foregoing resonance circuit, wherein the distance between the first connecting point and the third connecting point is defined as the first distance, and the distance between the second connecting point and the third connecting point is defined as the second distance, the ratio of the second distance to the first distance ranging from 1 to 5.

BRIEF DESCRIPTION OF THE SEVERAL VIEWS OF THE DRAWINGS

The objectives, as well as the technical features and their effects, of the present invention will be best understood by referring to the following detailed description of some illustrative embodiments in conjunction with the accompanying drawings, in which.

DETAILED DESCRIPTION OF THE INVENTION

Figure 1:
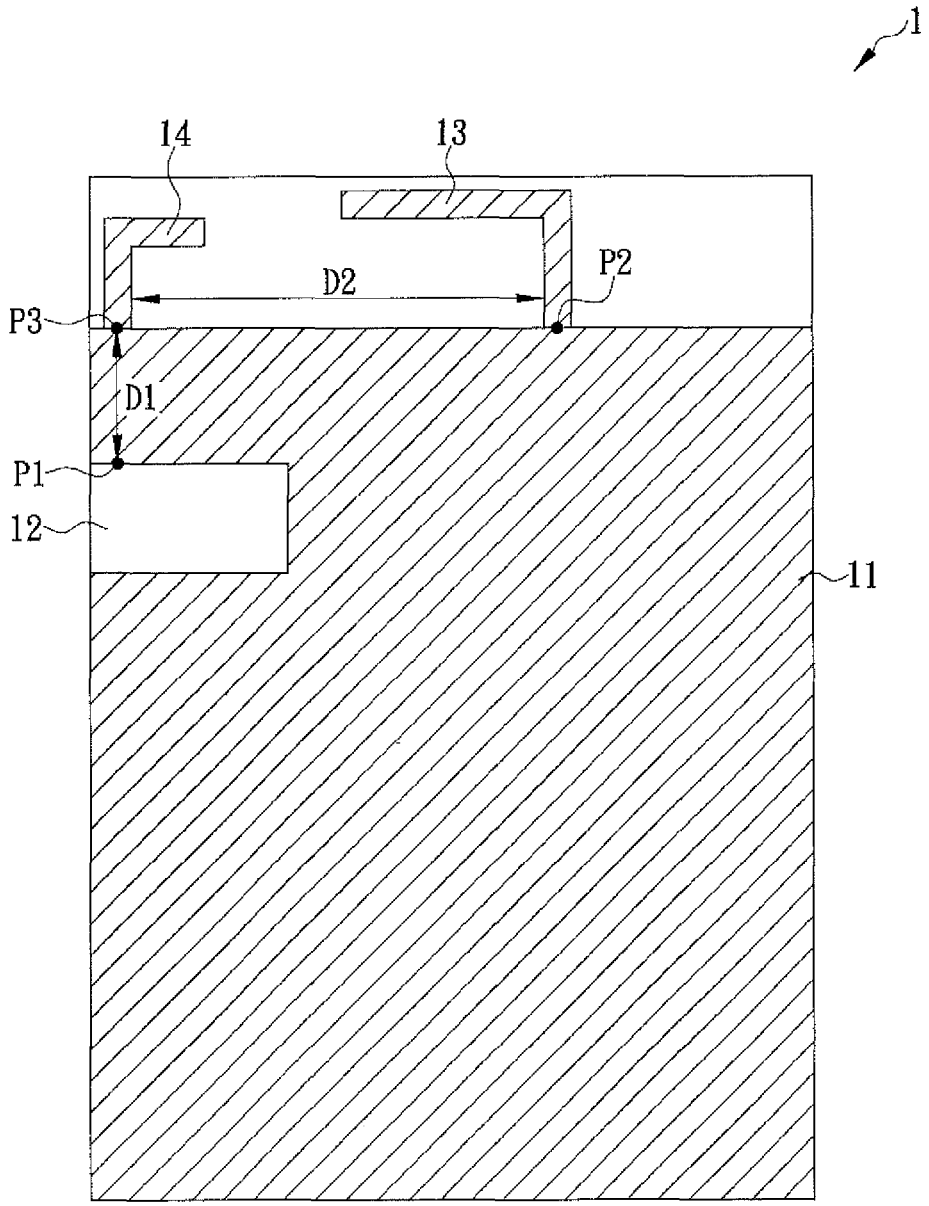
FIG. 1 is a schematic drawing of the first preferred embodiment of the present invention.

The first objective of the present invention is to provide a resonance circuit for inhibiting interference between a high-speed connector and an antenna. Referring to FIG. 1 for the first preferred embodiment of the present invention, the resonance circuit 14 is applied to the circuit board 11 of an electronic device 1, wherein the circuit board 11 is provided thereon with a circuit layout, a high-speed connector (e.g., a USB 3.0, HDMI, DisplayPort, or Thunderbolt connector), and an antenna 13. The high-speed connector 12 and one end of the antenna 13 are connected to a first connecting point P1 and a second connecting point P2 of the circuit layout respectively. The high-speed connector 12 is provided at a lateral side of the circuit layout so that, when the electronic device 1 is connected to a second electronic device (not shown) through the high-speed connector 12, information can be transmitted between the electronic device 1 and the second electronic device. In the first preferred embodiment of the present invention, the antenna 13 is an L-shaped microstrip antenna which enables the electronic device 1 to receive and transmit wireless signal at a predetermined frequency (e.g., 2.4 GHz); however, the configuration of the antenna 13 is not limited to the foregoing and may vary as appropriate. For example, the antenna 13 may be an L-shaped, F-shaped, inverted F-shaped, T-shaped, I-shaped, or inverted square U-shaped monopole, a planar inverted F-shaped antenna, an inverted F-shaped antenna, an inverted L-shaped antenna, a meander-line antenna, or a dipole antenna.

Referring to FIG. 1, the resonance circuit 14 is connected to a third connecting point P3 of the circuit layout, wherein the third connecting point P3 is provided between the first connecting point P1 and the second connecting point P2. The distance between the third connecting point P3 and the first connecting point P1 is defined as the first distance D1, the distance between the third connecting point P3 and the second connecting point P2 is defined as the second distance D2, and the first distance D1 is smaller than the second distance D2. In the first preferred embodiment, the first distance D1 is 17 mm, the second distance D2 is 85 mm, so the ratio of the second distance D2 to the first distance D1 is 5. Nevertheless, the arrangement of the resonance circuit 14 is not limited to the above. In other embodiments of the present invention, the ratio of the second distance D2 to the first distance D1 may be adjusted as needed. For example, it is feasible to set both the first and the second distances D1 and D2 at 45 mm; in that case, the ratio of the second distance D2 to the first distance D1 is 1. Besides, it is obvious to one skilled in the art that the first distance D1 may be set at any value between 15 mm and 45 mm, and the second distance D2 at any value between 45 mm and 85 mm, thereby changing the ratio of the second distance D2 to the first distance Dl. The values given above are intended only to show some feasible embodiments of the present invention and should not be construed as limitations imposed on the scope of the patent protection sought. All equivalent changes readily conceivable by a person skilled in the art should fall within the scope of the appended claims.

Figure 2:
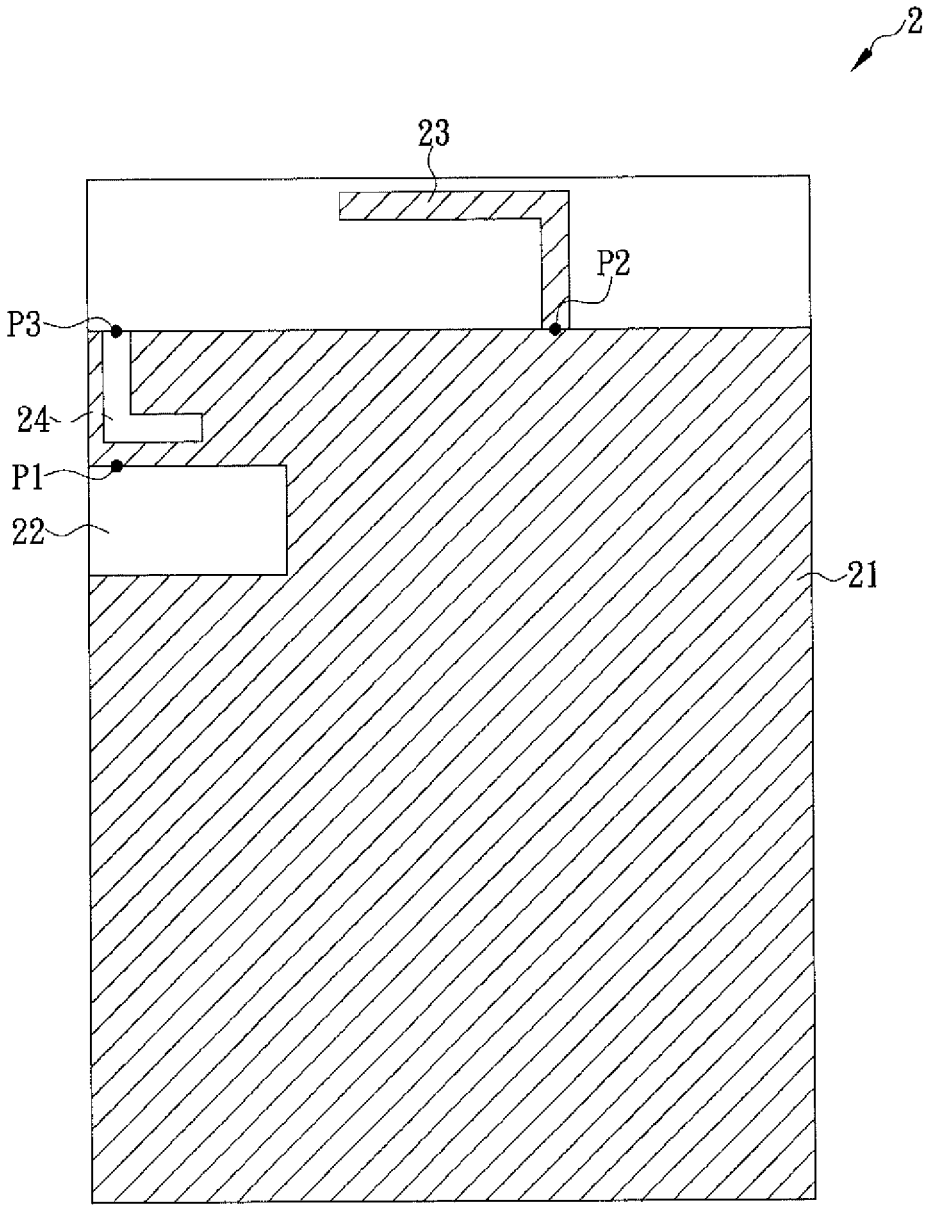
FIG. 2 is a schematic drawing of the second preferred embodiment of the present invention.

In the first preferred embodiment, the resonance circuit 14 is an L-shaped microstrip line whose length ranges from one fifth to one third of a wavelength (e.g., one fourth of the wavelength). However, the configuration of the resonance circuit 14 is not limited to the above and may vary as appropriate. For example, referring to FIG. 2 for the second preferred embodiment of the present invention, in which the circuit board 21 of the electronic device 2 is provided thereon with a circuit layout, the resonance circuit 24 of the electronic device 2 is designed as an L-shaped etched line starting from the third connecting point P3 of the circuit layout while the relative positions of the resonance circuit 24, the high-speed connector 22, and the antenna 23 of the electronic device 2 are similar to those in the first preferred embodiment. This alternative design is equally capable of achieving the intended effects of the present invention. Referring back to FIG. 1, the resonance circuit 14 has a resonance frequency (e.g., 2.4~2.5 GHz) covering the reception and transmission frequency of the antenna 13 (e.g., 2.4 GHz), and because of that, the resonance circuit 14 can absorb noise which is generated by the high-speed connector 12 and whose frequency is close to the frequency of the antenna 13. More specifically, when information is transmitted between the electronic device 1 and a second electronic device connected thereto through the high-speed connector 12, the high-speed connector 12 generates radiation signals, and the noise of the radiation signals that has a similar frequency to the antenna 13 will be absorbed by the resonance circuit 14 without reaching the antenna 13. Thus, the adverse effects of the radiation signals on the antenna 13 are effectively reduced.

Figure 3:
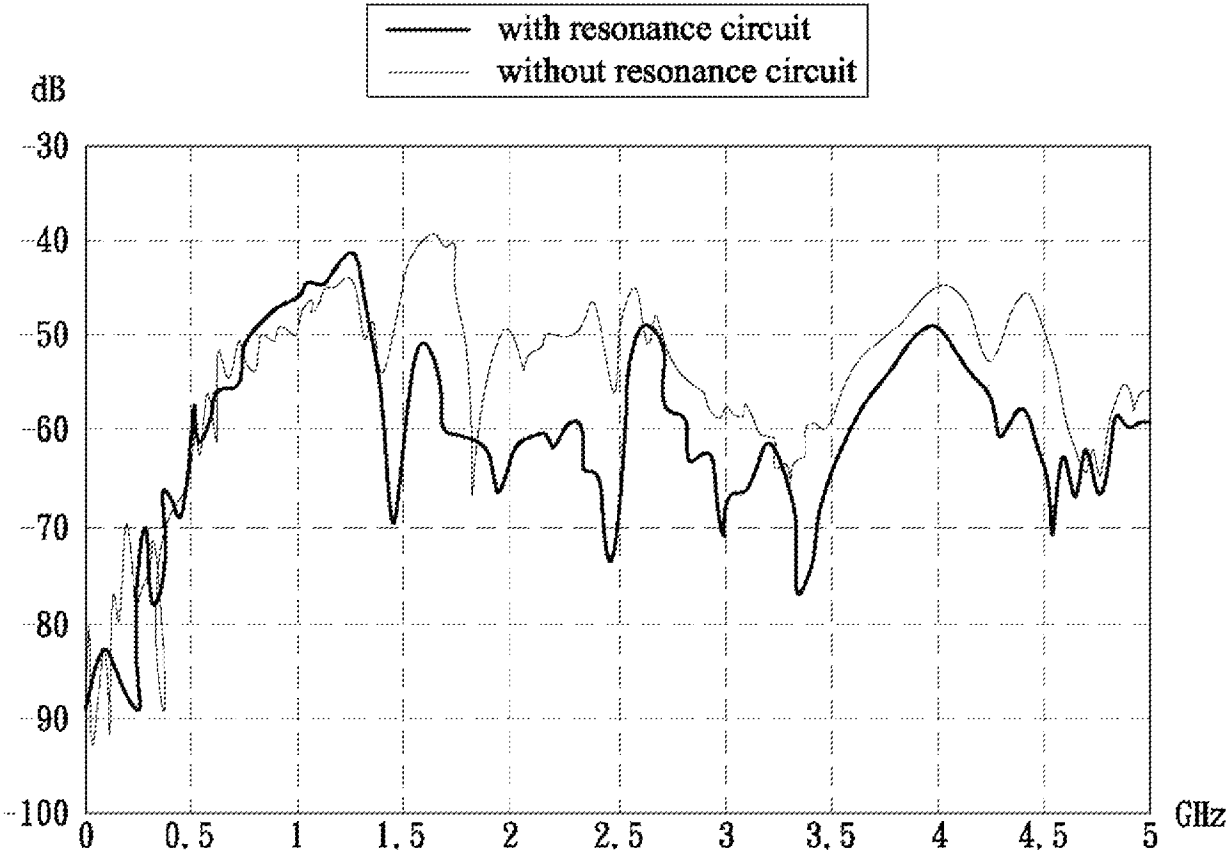
FIG. 3 is a plot showing noise isolation results with and without the resonance circuit of the present invention.

FIG. 3 is plotted using actual measurements taken by the inventor of the present invention while testing the degree of isolation between the high-speed connector 12 and the antenna 13 of the electronic device 1 (with the resonance circuit 14) and between the high-speed connector and the antenna of a second electronic device (without the resonance circuit 14). The thicker curve represents the measurements taken from the electronic device 1 with the resonance circuit 14, and the thinner curve represents the measurements taken from the second electronic device without the resonance circuit 14. As shown in the plot, the degree of isolation between the high-speed connector 12 and the antenna 13 is as high as about −70~−60 dB over the frequency band commonly used for wireless signal transmission (i.e., about 2.4 GHz), in the presence of the resonance circuit 14; the degree of isolation between the high-speed connector 12 and the antenna 13 of the second electronic device, on the other hand, is only about −55~−50 dB, in the absence of the resonance circuit 14. Obviously, the provision of the resonance circuit 14 between the speed connector 12 and the antenna 13 is effective in isolating the antenna 13 and the high-speed connector 12.

The resonance circuit has a better isolation effect when it is perpendicular to the antenna. Moreover, the isolation effect increases with the length of the resonance circuit.

According to the above, when information is transmitted between the electronic device 1 and a second electronic device through the high-speed connector 12, the high-speed connector 12 generates radiation signals, and the noise in the radiation signals that has a similar frequency to the antenna 13 will be absorbed by the resonance circuit 14 between the high-speed connector 12 and the antenna 13 and thus kept from affecting the antenna 13. In contrast to the prior art, which involves equipping the high-speed connector of an electronic device with a shielding housing or equipping the signal lines of the high-speed connector with a shielding housing or a wave-absorbing material, the present invention is obviously more advantageous in terms of cost because the resonance circuit 14 for reducing noise interference can be realized simply through circuit planning, without requiring the manufacture of a shielding housing or the provision of an additional wave-absorbing material.

While the invention herein disclosed has been described by means of specific embodiments, numerous modifications and variations could be made thereto by those skilled in the art without departing from the scope of the invention set forth in the claims.

What is claimed is:

1. A resonance circuit for inhibiting interference between a high-speed connector and a microstrip or etched antenna, the resonance circuit being applicable to a circuit board of an electronic device, the circuit board being provided thereon with a circuit layout, the high-speed connector, and the antenna, the high-speed connector being provided at a lateral side of the circuit layout so that information can be transmitted between the electronic device and a second electronic device through the high-speed connector, the antenna enabling the electronic device to receive and transmit wireless signal at a predetermined frequency, the high-speed connector and one end of the antenna being respectively connected to a first connecting point and a second connecting point of the circuit layout, wherein a distance between the first connecting point and the second connecting point is not less than one wavelength of the wireless signal, the resonance circuit being characterized in that:

the resonance circuit is a microstrip line provided on the circuit board outside the circuit layout, or an etched line provided within the circuit layout, and having one end connected to a third connecting point of the circuit layout;

the third connecting point is provided on the circuit layout at a position between the first connecting point and the second connecting point;

the resonance circuit has a resonance frequency covering a reception and transmission frequency of the antenna; and a first distance between the first connecting point and the third connecting point is smaller than a second distance between the second connecting point and the third connecting point.

2. The resonance circuit of claim 1, wherein the high-speed connector on the circuit board is a connector conforming to the Universal Serial Bus (USB) 3.0 specifications.

3. The resonance circuit of claim 1, wherein the high-speed connector on the circuit board is a High-Definition Multimedia Interface (HDMI) connector.

4. The resonance circuit of claim 1, wherein the high-speed connector on the circuit board is a DisplayPort connector.

5. The resonance circuit of claim 1, wherein the high-speed connector on the circuit board is a Thunderbolt connector.

6. The resonance circuit of claim 1, wherein the antenna on the circuit board is the microstrip antenna having one end connected to the second connecting point of the circuit layout.

7. The resonance circuit of claim 1, wherein the antenna on the circuit board is the etched antenna that starts from the second connecting point of the circuit layout.

8. The resonance circuit of claim 6, wherein the antenna on the circuit board is an L-shaped, F-shaped, inverted F-shaped, T-shaped, I-shaped, or inverted square U-shaped antenna.

9. The resonance circuit of claim 7, wherein the antenna on the circuit board is an L-shaped, F-shaped, inverted F-shaped, T-shaped, I-shaped, or inverted square U-shaped antenna.

10. The resonance circuit of claim 1, wherein the resonance circuit is an L-shaped, F-shaped, inverted F-shaped, T-shaped, I-shaped, or inverted square U-shaped antenna.

11. The resonance circuit of claim 10, wherein the resonance circuit has a length ranging from one fifth to one third of the wavelength.

12. The resonance circuit of claim 10, wherein a ratio of the second distance to the first distance ranges from 1 to 5.

* * * * *